US011807979B2

(12) United States Patent
Weirauch et al.

(10) Patent No.: US 11,807,979 B2
(45) Date of Patent: Nov. 7, 2023

(54) FILTER ARRANGEMENT FOR A LAUNDRY TREATMENT MACHINE AND LAUNDRY TREATMENT MACHINE

(71) Applicant: Miele & Cie. KG, Gütersloh (DE)

(72) Inventors: Fabian Weirauch, Gütersloh (DE); Thomas Vartmann, Beelen (DE)

(73) Assignee: MIELE & CIE. KG, Gütersloh (DE)

( * ) Notice: Subject to any disclaimer, the term of this patent is extended or adjusted under 35 U.S.C. 154(b) by 89 days.

(21) Appl. No.: 17/454,901

(22) Filed: Nov. 15, 2021

(65) Prior Publication Data

US 2022/0154386 A1 May 19, 2022

(30) Foreign Application Priority Data

Nov. 16, 2020 (DE) ..... 102020130204.5

(51) Int. Cl.
*D06F 39/10* (2006.01)
*D06F 58/22* (2006.01)
*D06F 25/00* (2006.01)

(52) U.S. Cl.
CPC ..... *D06F 39/10* (2013.01); *D06F 58/22* (2013.01); *D06F 25/00* (2013.01)

(58) Field of Classification Search
CPC ..... D06F 37/28; D06F 39/10; D06F 39/14; D06F 37/42; D06F 33/47; D06F 33/74; D06F 58/22; D06F 25/00
See application file for complete search history.

(56) References Cited

U.S. PATENT DOCUMENTS

2015/0252516 A1* 9/2015 Cho ..... D06F 58/22 34/82

FOREIGN PATENT DOCUMENTS

| | | | |
|---|---|---|---|
| DE | 19745091 | A1 | 4/1998 |
| EP | 1826308 | A1 | 8/2007 |
| EP | 2664706 | A1 | 11/2013 |

OTHER PUBLICATIONS

German Search Report dated Jun. 17, 2021.
European Search Report and Written Opinion dated Mar. 29, 2022.

* cited by examiner

*Primary Examiner* — Joseph L. Perrin
(74) *Attorney, Agent, or Firm* — Dickinson Wright PLLC

(57) ABSTRACT

The disclosure relates to a laundry treatment machine and a filter arrangement for therefor, comprising a filter receptacle, a filter, a flap that can pivot about a pivot axis, and a blocking device having a blocking part that is preloaded by means of a spring. The filter is configured to be transferred back and forth between a receiving position and an extraction position, the flap configured to be transferred back and forth along an actuation path between a closed position and an open position. A blocking part is configured to be transferred back and forth between a blocking position which prevents the flap from being transferred to the closed position, and a release position which enables the flap to be transferred to the closed position. The blocking part can be a slide movably mounted in a slide guide which runs transversely to the actuation path of the flap.

12 Claims, 6 Drawing Sheets

FILTER ARRANGEMENT FOR A LAUNDRY TREATMENT MACHINE AND LAUNDRY TREATMENT MACHINE

RELATED APPLICATIONS

The present disclosure claims priority to and the benefit of German Application 10 2020 130 204.5 filed on Nov. 16, 2020, the entire contents of which are incorporated herein by reference.

TECHNICAL FIELD

The disclosure relates to a filter arrangement for a laundry treatment machine of the type mentioned in the preamble of claim 1 and to a laundry treatment machine.

BACKGROUND

Filter arrangements of this type for laundry treatment machines as well as laundry treatment machines are already known from the prior art in a large number of embodiments. The known filter arrangements comprise a filter receptacle, a filter, a flap that can pivot about a pivot axis, and a blocking device having a blocking part that is preloaded by means of a spring of the blocking device, it being possible for the filter to be transferred back and forth between a receiving position in which the filter is received in the filter receptacle and an extraction position in which the filter is extracted from the filter receptacle, and it being possible for the flap to be transferred back and forth along an actuation path between a closed position, in which the flap covers the filter receptacle in such a way that the flap forms an optical unit (e.g. a unified visual appearance) with a remainder of the laundry treatment machine and/or enables the laundry treatment machine to be started up, and an open position in which the flap uncovers the filter receptacle, and it being possible for the blocking part of the blocking device to be transferred back and forth between a blocking position in which the blocking part prevents the flap from being transferred to the closed position thereof, and a release position in which the blocking part enables the flap to be transferred to the closed position thereof, specifically in such a way that the spring preloads the blocking part in the direction of the blocking position thereof and the blocking part can be transferred in the direction of the release position thereof by means of the filter against a spring force of the spring and can be held in the release position.

The disclosure therefore addresses the problem of providing an improved filter arrangement for a laundry treatment machine and an improved laundry treatment machine.

SUMMARY

According to the disclosure, this problem is solved by a filter arrangement for a laundry treatment machine having the features of claim 1, which is characterized in that the blocking part is designed as a slide that is movably mounted in a slide guide of the filter arrangement, which guide runs transversely to the actuation path of the flap, the slide guide having a first end stop, which corresponds to the blocking position, for the slide, and having a second end stop, which corresponds to the release position, for the slide. Furthermore, this problem is solved by a laundry treatment machine having the features of claim 9. The laundry treatment machine according to the disclosure can be designed as a tumble dryer for textiles or a washer-dryer for textiles.

Furthermore, the laundry treatment machine according to the disclosure can be designed as a household appliance or a commercial appliance, i.e., a device for professional use. Advantageous embodiments and developments of the disclosure result from the subsequent dependent claims.

The advantage that can be achieved by the disclosure consists in particular in that a filter arrangement for a laundry treatment machine and a laundry treatment machine are improved. On the basis of the design according to the disclosure of the filter arrangement for a laundry treatment machine and of the laundry treatment machine, it is made possible that the flap is not undesirably preloaded by the blocking device having the blocking part preloaded by the spring. In contrast to this, in the case of the known filter arrangements and laundry treatment machines, the fact is that the flap is constantly under mechanical stress on account of the blocking part being preloaded by means of the spring. This is where the disclosure provides a remedy. Accordingly, the filter arrangement according to the disclosure and the laundry treatment machine according to the disclosure are simpler and therefore more cost-effective in terms of construction as well as more durable.

In principle, the filter arrangement according to the disclosure for a laundry treatment machine can be freely selected, within wide suitable limits, according to the type, mode of operation, material, dimensioning, and arrangement.

According to an advantageous development of the filter arrangement according to the disclosure, the filter has a filter handle, the blocking device and the filter being designed to coordinate with one another in such a way that the slide can be transferred from the blocking position thereof to the release position thereof by means of the filter handle and can be held in the release position. In this way, the filter is easier to handle. Additionally, it is thereby possible to make the transfer of the slide from its blocking position to its release position dependent not only on the transfer of the filter from its extraction position to its receiving position, but additionally on the relative position of the filter handle. Accordingly, it is possible, for example, to enable or prevent the transfer of the slide from its blocking position to its release position depending on a proper position of the filter handle relative to the filter receptacle and/or the flap.

According to an advantageous development of the above-mentioned embodiment of the filter arrangement according to the disclosure, the filter and the filter receptacle are designed to coordinate with one another in such a way that the filter handle can be transferred back and forth between a locked position, in which the filter handle is locked by the filter receptacle, and an unlocked position, in which the filter handle is not locked by the filter receptacle, it being possible for the slide to be simultaneously transferred to the release position thereof by means of the filter handle when said handle is transferred to the locked position and to be held in the release position, and it being possible for the slide to be simultaneously transferred to the blocking position of the slide by means of the spring when the filter handle is transferred to the unlocked position thereof. This ensures that it is only possible to transfer the slide from its blocking position to its release position when the filter is properly located in its receiving position and is locked by means of the filter handle. In addition, to transfer the slide from its release position to its blocking position, it is only necessary to transfer the filter handle from its locked position to its unlocked position.

According to an advantageous development of the filter arrangement according to claim 3 of the disclosure, the filter receptacle has at least one circular arc guide and the filter handle has at least one circular arc projection which corresponds to the circular arc guide, the circular arc projection and the circular arc guide being designed to coordinate with one another in such a way that the filter handle can be locked in the filter receptacle by means of the circular arc projection and the circular arc guide when said filter handle is transferred to the locked position and can be unlocked when it is transferred to the unlocked position. In this way, the mechanism for the filter handle for transferring the filter handle from its unlocked position to its locked position and vice versa is realized in a simple and space-saving way in terms of design and manufacturing.

According to an advantageous development of the last-mentioned embodiment of the filter arrangement according to the disclosure, at least one of the at least one circular arc guide is arranged relative to the slide guide in such a way that the slide guided in the slide guide can be transferred back and forth between the blocking position and the release position by means of an actuating projection of the slide and of the circular arc projection of the filter handle, which projection corresponds to the above-mentioned circular arc guide. As a result, the mechanical coupling of the filter handle, which is guided in the circular arc guide of the filter receptacle, to the slide of the blocking device, which slide is guided in the slide guide, is made possible in a particularly simple manner in terms of design.

According to a further advantageous development of the filter arrangement according to the disclosure, the spring is designed as a separate part, preferably as a metal part. In this way, it is possible, for example, to select or design the spring independently of the design and manufacturing conditions for the slide. In addition, metal springs, for example sheet metal springs or wire springs, are particularly robust and are commercially available in a large number of different embodiments. In contrast to this, however, it is also conceivable in principle for the spring to be designed as an integral part of the slide, for example a slide made of a plastic.

According to another advantageous development of the filter arrangement according to the disclosure, the slide and the slide guide have latching means that correspond to one another, the slide being movably arranged on the filter receptacle by means of said latching means. As a result, the movable mounting of the slide on the slide guide is realized in a particularly simple and robust manner in terms of design.

According to a further advantageous development of the filter arrangement according to the disclosure, the flap has a flap projection, the flap projection and the blocking device being designed to coordinate with one another and arranged in such a way that the slide, in the blocking position thereof, is in engagement with only the flap projection and, in the release position thereof, is not in engagement with the flap projection. In this way, the mechanical operative connection between the blocking device on the one side and the flap on the other side is implemented in a simple manner in terms of design and manufacturing. Furthermore, this does not impair the aesthetic design of the flap in its closed position, for example as a design unit with a body of the laundry treatment machine.

According to an advantageous development of the laundry treatment machine according to the disclosure, the filter arrangement, preferably the filter receptacle, is at least partially designed as a part of the housing. This reduces the number of components and simplifies the structural design of the laundry treatment machine. This applies in particular to the preferred embodiment of this development.

BRIEF DESCRIPTION OF THE DRAWINGS

An exemplary embodiment of the disclosure is shown purely schematically in the drawings and will be described in more detail below. In the drawings.

DETAILED DESCRIPTION OF THE DRAWINGS

Figure 1:
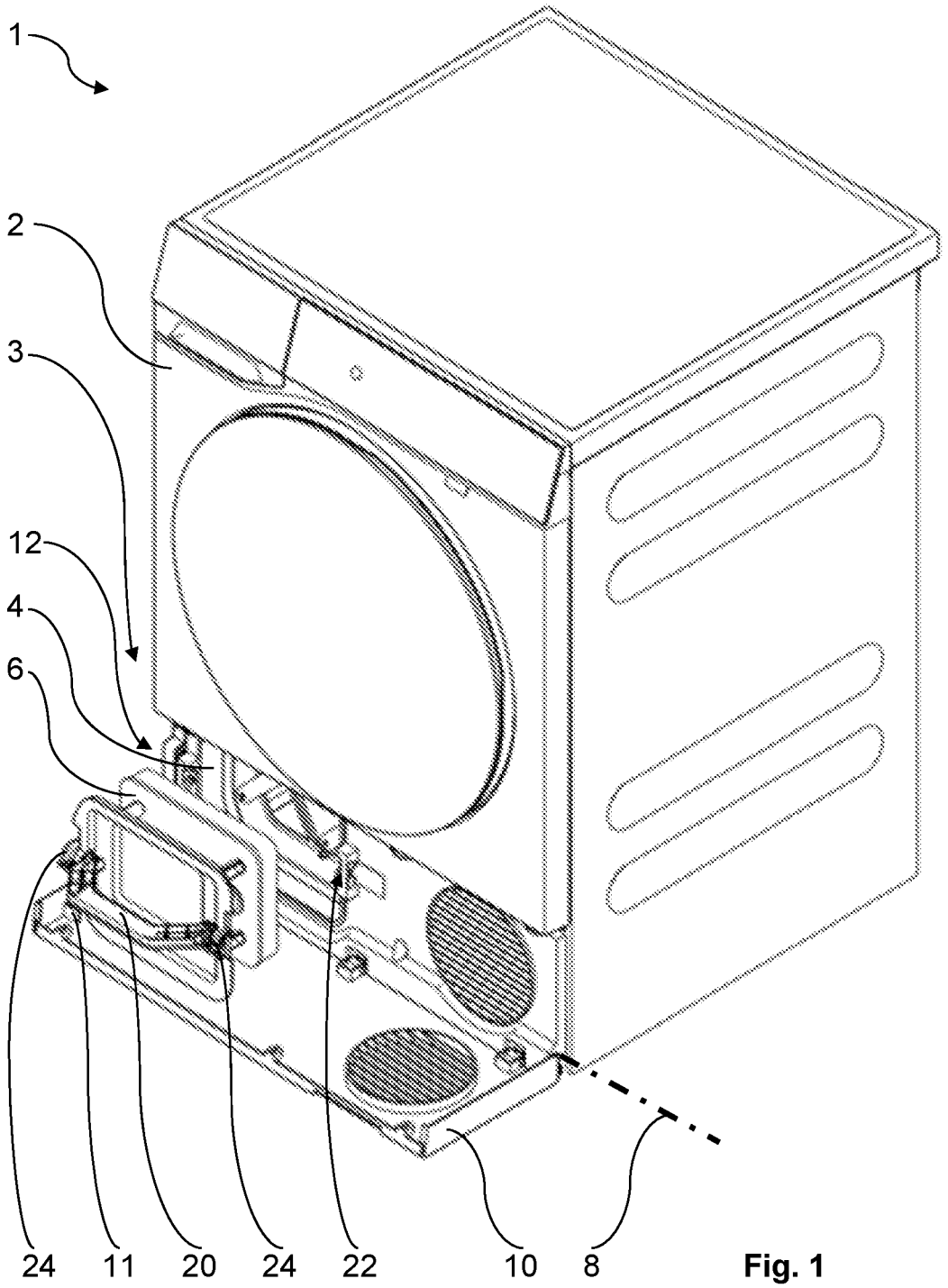
FIG. 1 shows an exemplary embodiment of the laundry treatment machine according to the disclosure in a first perspective representation, with the flap in its open position.
Figure 2A:
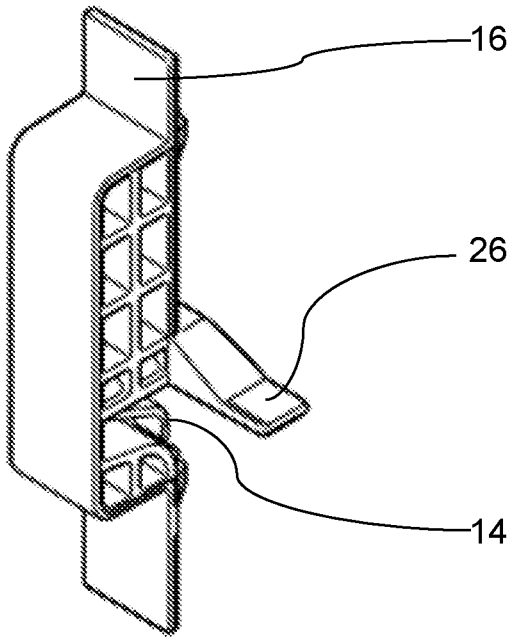
FIG. 2*a* shows the slide of the exemplary embodiment in a perspective view and FIG. 2*b* is a side view of the slide of FIG. 2*a;*
Figure 2B:
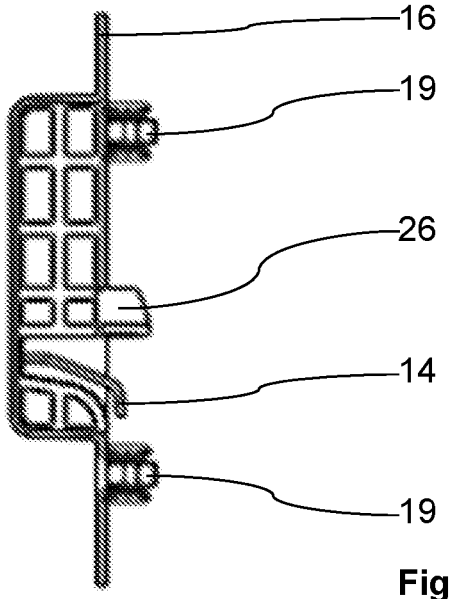
Figure 3:
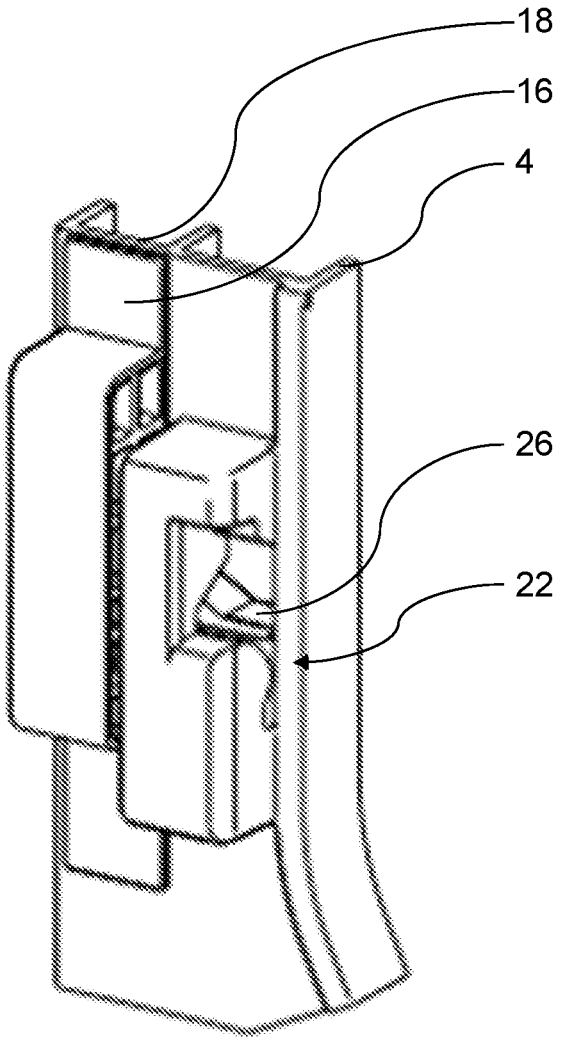
FIG. 3 shows the exemplary embodiment in an enlarged, partial detailed representation in the area of the slide, in a perspective view.

In FIGS. 1 to 7, an exemplary embodiment of the laundry treatment machine according to the disclosure having the filter arrangement according to the disclosure is shown purely by way of example.

The laundry treatment machine 1 is designed as a household tumble dryer for textiles and has a housing 2 and a filter arrangement 3. The filter arrangement 3 comprises a filter receptacle 4, a filter 6, a flap 10 that can pivot about a pivot axis 8, and a blocking device 12 having a blocking part 16 that is preloaded by means of a spring 14 of the blocking device 12, it being possible for the filter 6 to be transferred back and forth between a receiving position, shown in FIGS. 4 and 5, in which the filter 6 is received in the filter receptacle 4, and an extraction position, shown in FIG. 1, in which the filter 6 is extracted from the filter receptacle 4, and it being possible for the flap 10 to be transferred back and forth along an actuation path between a closed position, shown in FIG. 7, in which the flap 10 covers the filter receptacle 4 in such a way that the flap 10 forms an optical unit (unified appearance) with a remainder of the laundry treatment machine 1 and enables the laundry treatment machine 1 to be started up, and an open position, shown in FIG. 1, in which the flap 10 uncovers the filter receptacle 4, and it being possible for the blocking part 16 of the blocking device 12 to be transferred back and forth between a blocking position, shown in FIGS. 1, 3 and 4, in which the blocking part 16 prevents the flap 10 from being transferred to the closed position thereof, and a release position, shown in FIG. 5, in which the blocking part 16 enables the flap 10 to be transferred to the closed position thereof, specifically in such a way that the spring 14 preloads the blocking part 16 in the direction of the blocking position thereof and the blocking part 16 can be transferred in the direction of the release position thereof by means of the filter 6 against a spring force of the spring 14 and can be held in the release position.

According to the disclosure, the blocking part 16 is designed as a slide that is movably mounted in a slide guide 18 of the filter arrangement 3, which guide runs transversely to the actuation path of the flap 10, the slide guide 18 having a first end stop, which corresponds to the blocking position, for the slide 16, and having a second end stop, which corresponds to the release position, for the slide 16. The slide 16 is designed as a plastic injection-molded part. In the present exemplary embodiment, the spring 14 is designed as a separate metal spring and is connected, in a manner known to a person skilled in the art, to the slide 16 such that force is transferred. The slide 16 and the slide guide 18 have latching means or a latch that correspond to one another, the slide 16 being movably arranged on the filter receptacle 4 by means of said latching means. In this regard, see in particular FIG. 2*b*, in which only the latching means 19 of the slide 16, which are designed as latching lugs, are shown. In a manner known to a person skilled in the art, these latching means 19 engage in the correspondingly designed latching means (not shown) of the slide guide 18, as a result of which the slide 16 is held movably in the slide guide 18 in such a manner that the slide 16 can be moved from top to bottom and from bottom to top in the respective image planes of FIGS. 1 to 5. The flap 10 has a flap projection 11, the flap projection 11 and the blocking device 12 being designed to coordinate with one another and arranged in such a way that the slide 16, in the blocking position thereof, is in engagement with only the flap projection 11 and, in the release position thereof, is not in engagement with the flap projection 11. In this regard, see in particular FIGS. 6 and 7.

In the present exemplary embodiment, the filter arrangement 3, specifically the filter receptacle 4, is at least partially designed as a part of the housing 2.

The filter 6, which is designed as a depth filter and is arranged in its receiving position fluidically upstream of a heat exchanger (not shown) of the laundry treatment machine 1, has a filter handle 20, the blocking device 12 and the filter 6 being designed to coordinate with one another in such a way that the slide 16 can be transferred from the blocking position thereof to the release position thereof by means of the filter handle 20 and can be held in the release position.

Figure 4:
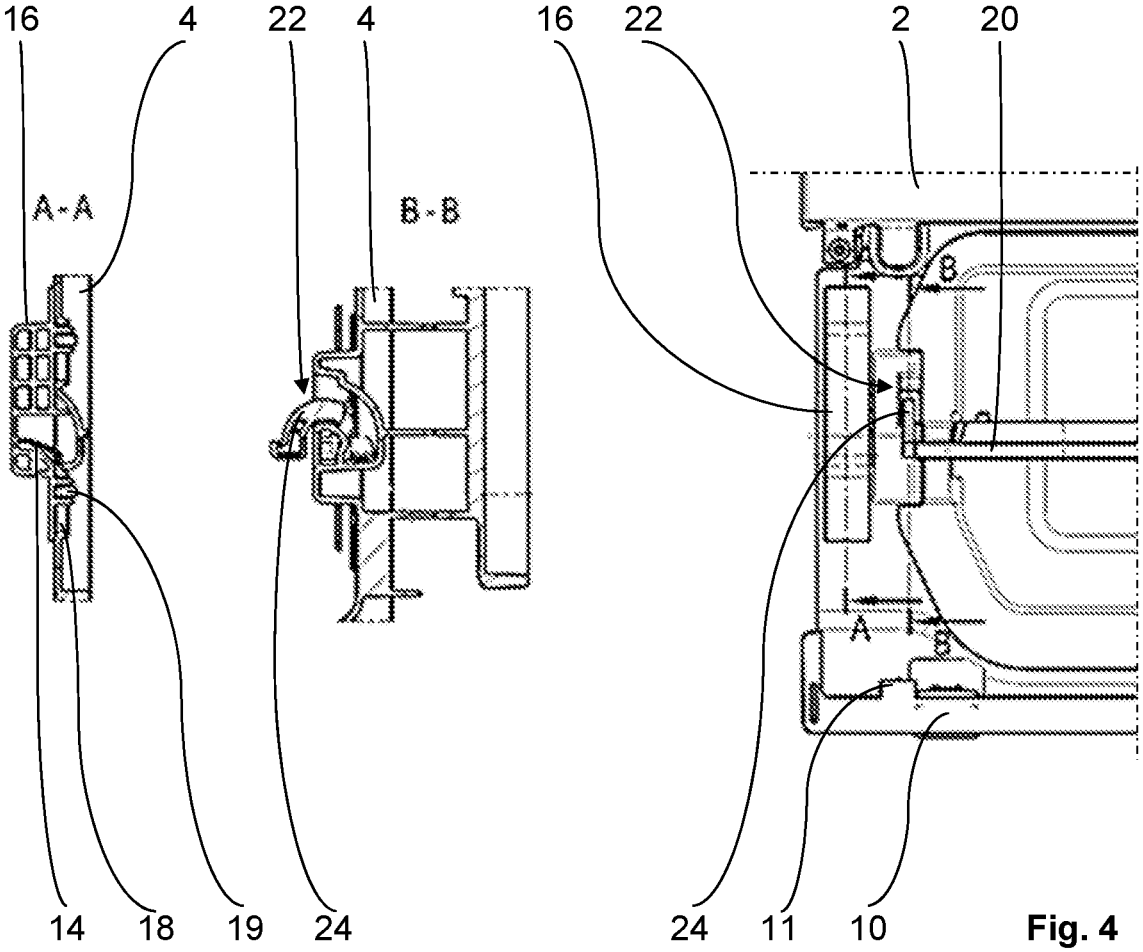
FIG. 4 shows the exemplary embodiment in three partial representations in the area of the flap, with the flap in its open position, with the filter in its receiving position and the filter handle in its unlocked position.
Figure 5:
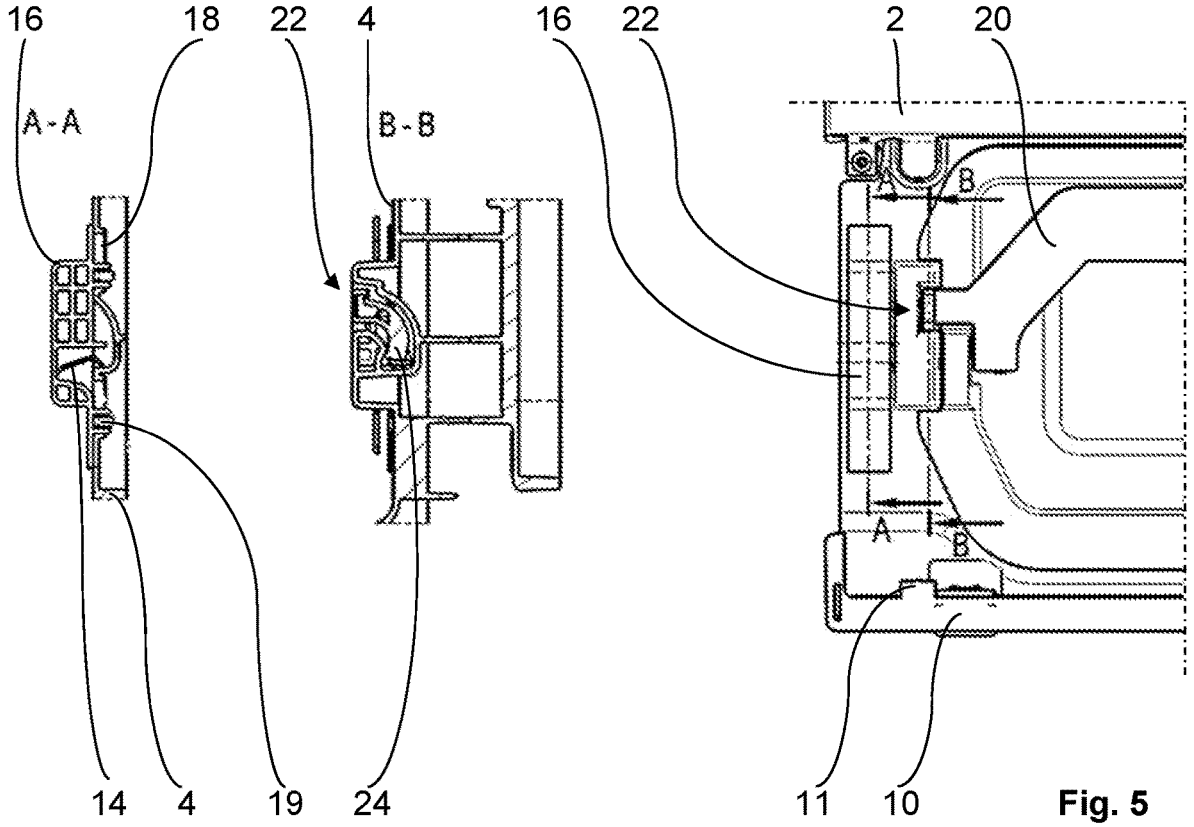
FIG. 5 shows the exemplary embodiment in three further partial representations in the area of the flap, with the flap in its open position, with the filter in its receiving position, and the filter handle in its locked position.

Furthermore, the filter 6 and the filter receptacle 4 are designed to coordinate with one another in such a way that the filter handle 20 can be transferred back and forth between a locked position, shown in FIG. 5, in which the filter handle 20 is locked by the filter receptacle 4, and an unlocked position, shown in FIG. 4, in which the filter handle 20 is not locked by the filter receptacle 4, it being possible for the slide 16 to be simultaneously transferred to the release position thereof by means of the filter handle 20 when said handle is transferred to the locked position and to be held in the release position, and it being possible for the slide 16 to be simultaneously transferred to the blocking position of the slide 16 by means of the spring 14 when the filter handle 20 is transferred to the unlocked position thereof.

For this purpose, the filter receptacle 4 has two circular arc guides 22 and the filter handle 20 has two circular arc projections 24 each corresponding to one of the two circular arc guides 22, the circular arc projections 24 and the circular arc guides 22 corresponding thereto being designed to coordinate with one another in such a way that the filter handle 20 can be locked in the filter receptacle 4 by means of the circular arc projections 24 and the circular arc guides 22 when said handle is transferred to the locked position and can be unlocked when it is transferred to the unlocked position.

One of the two circular arc guides 22 is arranged relative to the slide guide 18 in such a way that the slide 16 guided in the slide guide 18 can be transferred back and forth between the blocking position and the release position by means of an actuating projection 26 of the slide 16 and of the circular arc projection 24 of the filter handle 20, which projection corresponds to the above-mentioned circular arc guide 22.

The mode of operation of the filter arrangement according to the disclosure and of the laundry treatment machine according to the disclosure as per the present exemplary embodiment will be explained in more detail below with reference to FIGS. 1 to 7.

Figure 7:
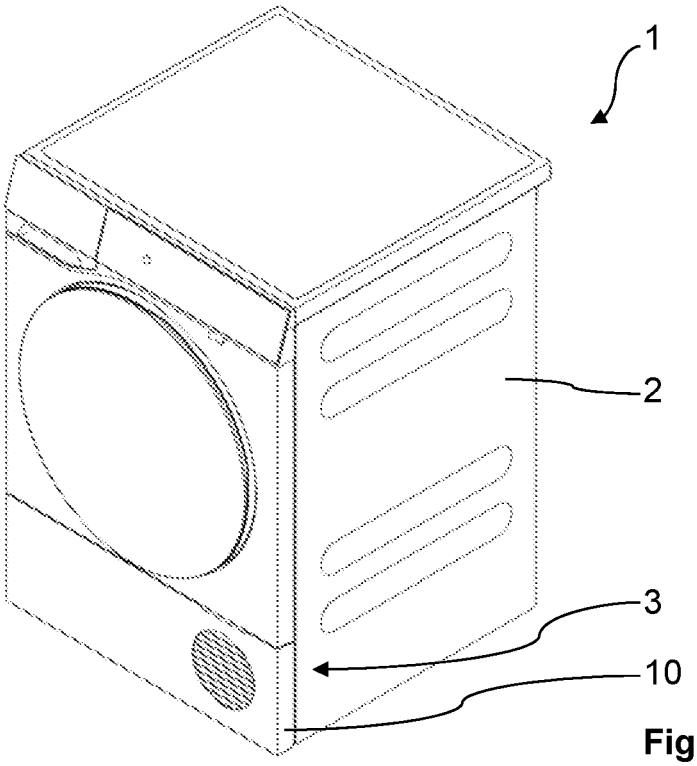
FIG. 7 shows the exemplary embodiment in a third perspective representation, with the flap in its closed position.

First of all, the laundry treatment machine 1 is in the state shown in FIG. 7, in which the flap 10 is in its closed position. When the flap 10 is in the closed position, said flap 10 forms an optical unit having a unified visual appearance with a remainder of the laundry treatment machine 1 and enables the laundry treatment machine 1 to be started up. For example, the above-mentioned possibility of starting the machine up can be realized in a simple manner using circuitry by means of a switch or the like which can be actuated when the flap 10 is in the closed position.

The filter 6 is in its receiving position, the filter handle 20 is in its locked position, and the slide 16 is in its release position. As can be seen from the above and the following statements, the flap 10 is not subjected to undesired mechanical stress in its closed position by the spring force of the spring 14. This is because the spring 14 which preloads the slide 16 acts transversely to the actuation path of the flap 10 due to the arrangement of the slide guide 18.

For the purpose of cleaning the filter 6, a user (not shown) opens the flap 10 by transferring it from its closed position to its open position, which is shown in FIGS. 1, 4, and 5.

The user can now transfer the filter handle 20 from its locked position, shown in FIG. 5, to its unlocked position, shown in FIGS. 1 and 4, and extract the filter 6 from the filter receptacle 4 by means of the filter handle 20 in a manner known to a person skilled in the art. The filter 6 is thus transferred from its receiving position, shown in FIGS. 4 and 5, to its extraction position, shown in FIG. 1. At the same time as the filter handle 20 is transferred from its locked position to its unlocked position, the slide 16 is transferred by means of the spring force of the spring 14 along the slide guide 18 from the release position of the slide to the blocking position thereof. The slide 16 is thus located in the position shown in FIGS. 1, 3, and 4, i.e., at the upper end stop of the slide guide 18.

Figure 6:
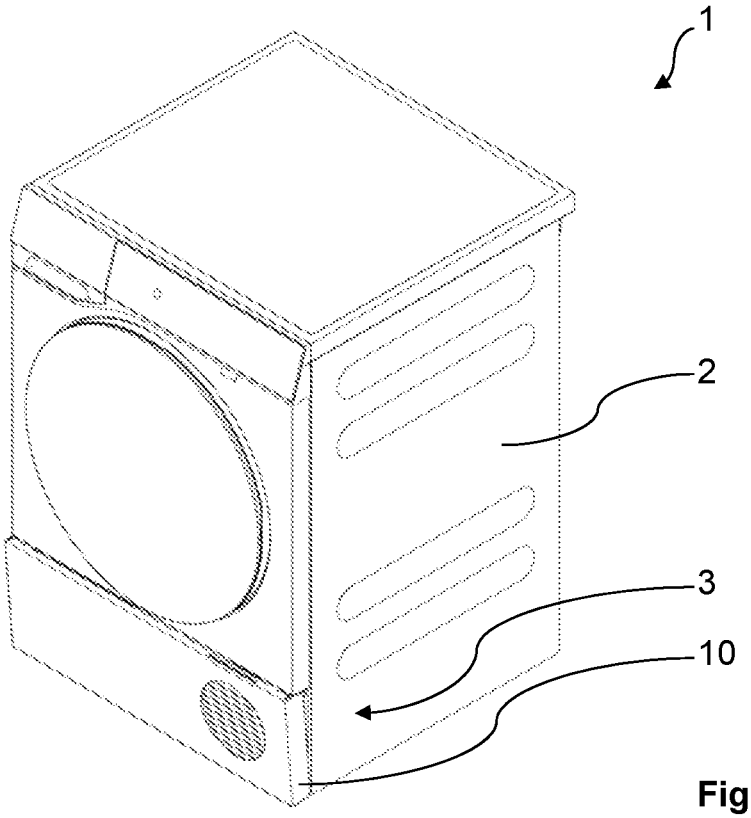
FIG. 6 shows the exemplary embodiment in a second perspective representation, with the flap blocked by the slide in the blocking position thereof.

For the purpose of cleaning or replacing the filter 6, for example, the filter handle 20 can be reusable, with only a remainder of the filter 6 being replaced. Accordingly, the filter handle 20 would be detachably fastened to the remainder of the filter 6. However, embodiments are also conceivable in which the filter 6 forms an undetachable unit and in which the filter handle can thus not be detached from the remainder of the filter. Since the slide 16 is in its blocking position, as explained above, the flap 10 would be prevented by means of the flap projection 11 and the slide 16 from being transferred to the closed position of the flap shown in FIG. 7. Instead, the flap 10 would hit the slide 16 with the flap projection 11, so that the flap 10 could only be transferred as far as an intermediate position, which is shown in FIG. 6.

The user would thus be able to easily detect by means of the flap 10 that the filter 6 has not been inserted into the filter receptacle 4 and has been locked by means of the filter handle 20. An additional electronic unit or the like for this detection is not required according to the disclosure. Even in the blocking position of the slide 16, the flap 10 is not subjected to mechanical stress on account of the spring force of the spring 14 which preloads the slide 16 in the direction of the blocking position thereof. Since the flap 10 is not in its closed position, the switch mentioned above by way of example (not shown) for starting up the laundry treatment machine 1 is not actuated by means of the flap 10, so that, when the flap 10 is located in the above-mentioned intermediate position, it is not possible to start up the laundry treatment machine 1, i.e., it is not possible to start the laundry treatment machine 1 for drying textiles to be dried.

After the filter 6 has been cleaned or replaced by the user, the user reinserts the filter 6 into the filter receptacle 4 by means of the filter handle 20. The filter 6 is thus transferred again from its extraction position to its receiving position. The filter 6 is now reinserted into the filter receptacle 4; see FIG. 4 in this regard.

In order to properly secure the filter 6 in its receiving position in the filter receptacle 4, the user transfers the filter handle 20 of the filter 6 from its unlocked position shown in FIG. 4 to its locked position shown in FIG. 5. To this end, in the present exemplary embodiment, the user rotates the filter handle 20 upward, in the respective image planes of FIGS. 4 and 5, about a pivot axis of the filter handle 20 that extends horizontally in the respective image planes of FIGS. 4 and 5. The filter 6 is thereby locked in its receiving position by means of the filter handle 20. In the process, the slide 16 is also transferred by means of the filter handle 20 from its blocking position shown in FIG. 4 to its release position shown in FIG. 5.

In the case of the above-mentioned transfer of the filter handle 20 from its unlocked position to its locked position, the filter handle 20, with its circular arc projections 24, enters into engagement with the circular arc guide 22 of the filter receptacle 4 that corresponds to the relevant circular arc projection 24. In the process, the filter handle 20, with its circular arc projection 24—shown on the left in the image plane of FIG. 1—also enters into engagement with the actuating projection 26 of the slide 16. The filter handle 20 thus presses the slide 16 down against the spring force of the spring 14 by means of the above-mentioned circular arc projection 24 and the actuation projection 26 along the slide guide 18 in the respective image planes of FIGS. 1 and 3 to 5, such that the slide 16 is transferred from its blocking position—shown in FIG. 4—to its release position—shown in FIG. 5.

For a better understanding, in the respective image planes of FIGS. 4 and 5, a longitudinal section denoted by A-A through the slide 16 is shown on the left, a longitudinal section denoted by B-B through the circular arc guide 22 is shown in the middle, and the laundry treatment machine 1 in the region of the filter receptacle 4 is shown on the right.

Since the filter 6 is in its receiving position in the filter receptacle 4, the filter handle 20 in its locked position and the slider 16 in its release position, the user can now transfer the flap 10 from its open position—shown in FIGS. 1, 4, and 5—to its closed position—shown in FIG. 7. The user can thus detect, without additional aids, by the closed position of the flap 10 that the filter 6 is correctly inserted in the filter receptacle 4 and has been locked by means of the filter handle 20. This is very important for proper and fault-free operation of the laundry treatment machine 1, since otherwise there would be a risk that the heat exchanger (not shown) of the laundry treatment machine 1 would become so dirty over time due to lint and the like that the laundry treatment machine 1 would no longer function. Due to the flap 10 now being back in its closed position, the switch mentioned above by way of example for starting up the laundry treatment machine 1 is also actuated, meaning that the user can now switch on the laundry treatment machine 1.

In contrast to known filter arrangements and laundry treatment machines, in which the flap is constantly under mechanical stress due to the blocking part preloaded by the spring, the design according to the disclosure of the filter arrangement for a laundry treatment machine and the laundry treatment machine according to the present exemplary embodiment are such that the flap 10 is not undesirably preloaded by the blocking device 12 having the blocking part 16 preloaded by the spring 14. Accordingly, the filter arrangement according to the disclosure and the laundry treatment machine according to the present exemplary embodiment of the disclosure is simpler and thus more cost-effective in terms of construction as well as more durable.

The disclosure is not limited to the present exemplary embodiment.

For example, the laundry treatment machine according to the disclosure does not necessarily have to be designed as a tumble dryer for textiles or a washer-dryer for textiles. Instead, the laundry treatment machine according to the disclosure can be designed, within suitable and meaningful limitations, as any type of laundry treatment machine. Furthermore, the laundry treatment machine according to the disclosure can be designed as a commercial appliance, i.e., a device for professional use.

In particular, the disclosure is not limited to the design and manufacturing details of the above-mentioned exemplary embodiment. Accordingly, the filter arrangement according to the disclosure and the laundry treatment machine according to the disclosure can be adapted to a large number of different applications and designs.

The invention claimed is:

1. A filter arrangement for a laundry treatment machine, comprising:

a filter receptacle, a filter, a flap that can pivot about a pivot axis, and a blocking device having a blocking part that is preloaded by way of a spring of the blocking device, wherein the filter is configured to be transferred back and forth between a receiving position in which the filter is received in the filter receptacle and an extraction position in which the filter is extracted from the filter receptacle, and wherein the flap is configured to be transferred back and forth along an actuation path between a closed position, in which the flap covers the filter receptacle in such a way that the flap forms an optical unit with a remainder of the laundry treatment machine and/or enables the laundry treatment machine to be started up, and an open position in which the flap uncovers the filter receptacle, wherein the blocking part of the blocking device is configured to be transferred back and forth between a blocking position, in which the blocking part prevents the flap from being transferred to the closed position thereof, and a release position in which the blocking part enables the flap to be transferred to the closed position thereof, in such a way that the spring preloads the blocking part in the direction of the blocking position thereof and the blocking part can be moved in the direction of the release position thereof by way of the filter against a spring force of the spring and can be held in the release position, designed as slide that is movably mounted in a slide guide of the filter arrangement, the slide guide running transversely to the actuation path of the flap, the slide guide having a first end stop, which corresponds to the blocking position for the slide, and having a second end stop, which corresponds to the release position for the slide.

2. The filter arrangement according to claim 1, wherein the filter has a filter handle, the blocking device and the filter being designed to coordinate with one another in such a way that the slide can be transferred from the blocking position thereof to the release position thereof by way of the filter handle and can be held in the release position.

3. The filter arrangement according to claim 2, wherein the filter and the filter receptacle are designed to coordinate with one another in such a way that the filter handle can be transferred back and forth between a locked position, in which the filter handle is locked by the filter receptacle, and an unlocked position in which the filter handle is not locked by the filter receptacle, the slide configured to be simultaneously transferred to the release position thereof by way of the filter handle when said handle is transferred to the locked position and to be held in the release position, and the slide configured to be simultaneously transferred to the blocking position of the slide by means of the spring when the filter handle is transferred to the unlocked position.

4. The filter arrangement according to claim 3, wherein the filter receptacle has at least one circular arc guide and the filter handle has at least one circular arc projection which corresponds to the circular arc guide, the circular arc projection and the circular arc guide being designed to coordinate with one another in such a way that the filter handle can be locked in the filter receptacle by way of the circular arc projection and the circular arc guide when said handle is transferred to the locked position and can be unlocked when it is transferred to the unlocked position.

5. The filter arrangement according to claim 4, wherein at least one of the at least one circular arc guide is arranged relative to the slide guide in such a way that the slide guided in the slide guide can be transferred back and forth between the blocking position and the release position by means of an actuating projection of the slide and of the circular arc projection of the filter handle, which projection corresponds to the at least one circular arc guide.

6. The filter arrangement according to claim 1, wherein the spring is designed as a separate part.

7. The filter arrangement according to claim 1, wherein the slide and the slide guide have latching parts that correspond to one another to form a latch, the slide being movably arranged on the filter receptacle by means of said latch.

8. The filter arrangement according to claim 1, wherein the flap has a flap projection, the flap projection and the blocking device being designed to coordinate with one another and arranged in such a way that the slide, in the blocking position thereof, is in engagement with only the flap projection and, in the release position thereof, is not in engagement with the flap projection.

9. The filter arrangement according to claim 1, wherein the spring is designed as a metal part.

10. A laundry treatment machine comprising:

a housing; and a filter arrangement, the filter arrangement having, a filter receptacle, a filter, a flap that can pivot about a pivot axis, and a blocking device having a blocking part that is preloaded by way of a spring of the blocking device, wherein the filter is configured to be transferred back and forth between a receiving position in which the filter is received in the filter receptacle and an extraction position in which the filter is extracted from the filter receptacle, and wherein the flap is configured to be transferred back and forth along an actuation path between a closed position, in which the flap covers the filter receptacle in such a way that the flap forms an optical unit with a remainder of the laundry treatment machine and/or enables the laundry treatment machine to be started up, and an open position in which the flap uncovers the filter receptacle, wherein the blocking part of the blocking device is configured to be transferred back and forth between a blocking position, in which the blocking part prevents the flap from being transferred to the closed position thereof, and a release position in which the blocking part enables the flap to be transferred to the closed position thereof, in such a way that the spring preloads the blocking part in the direction of the blocking position thereof and the blocking part can be moved in the direction of the release position thereof by way of the filter against a spring force of the spring and can be held in the release position, designed as slide that is movably mounted in a slide guide of the filter arrangement, the slide guide running transversely to the actuation path of the flap, the slide guide having a first end stop, which corresponds to the blocking position for the slide, and having a second end stop, which corresponds to the release position for the slide.

11. The laundry treatment machine according to claim 10, wherein the filter arrangement is at least partially designed as a part of the housing.

12. The laundry treatment machine according to claim 10, wherein the filter receptacle is at least partially designed as a part of the housing.

* * * * *